US009529314B2

(12) United States Patent
Suzuki et al.

(10) Patent No.: US 9,529,314 B2
(45) Date of Patent: Dec. 27, 2016

(54) IMAGE FORMING APPARATUS AND SURFACE PROCESSING APPARATUS

(71) Applicant: FUJI XEROX CO., LTD., Tokyo (JP)

(72) Inventors: Wataru Suzuki, Kanagawa (JP); Satoshi Tatsuura, Kanagawa (JP); Mamoru Fujita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/833,550

(22) Filed: Aug. 24, 2015

(65) Prior Publication Data

US 2016/0246206 A1 Aug. 25, 2016

(30) Foreign Application Priority Data

Feb. 23, 2015 (JP) ..... 2015-032838

(51) Int. Cl.
*G03G 15/00* (2006.01)

(52) U.S. Cl.
CPC ..... *G03G 15/6582* (2013.01); *G03G 15/6573* (2013.01); *G03G 15/652* (2013.01); *G03G 2215/00426* (2013.01); *G03G 2215/00789* (2013.01)

(58) Field of Classification Search
CPC ..... G03G 15/6573; G03G 15/6582; G03G 2215/00789; G03G 2215/00426; G03G 2215/00417
See application file for complete search history.

(56) References Cited

U.S. PATENT DOCUMENTS 4,208,697 A * 6/1980 Fischer ..... G03G 15/0291 250/324
6,624,413 B1 * 9/2003 Klein ..... H01T 19/00 250/324
7,672,634 B2 * 3/2010 Lofthus ..... G03G 15/2003 399/341
8,368,731 B2 * 2/2013 Klenkler ..... B41J 2/41 347/151
2004/0085423 A1 * 5/2004 Bronstein ..... B41J 11/002 347/102
2005/0220518 A1 * 10/2005 Priebe ..... G03G 15/1695 399/390
2006/0290760 A1 * 12/2006 German ..... G03G 15/2007 347/102
2011/0064489 A1 3/2011 Bisaiji et al.
2011/0206401 A1 * 8/2011 Sone ..... G03G 15/0194 399/67

(Continued)

FOREIGN PATENT DOCUMENTS

JP 2011-059575 A 3/2011
JP 5500417 B2 5/2014

*Primary Examiner* — David Gray
*Assistant Examiner* — Carla Therrien
(74) *Attorney, Agent, or Firm* — Oliff PLC

(57) ABSTRACT

Provided is an image forming apparatus including an image forming section that forms a toner image according to image data on a transported recording medium, a reforming section that generates a polar group on a first surface of the recording medium on which the toner image is formed, and a control section that sets target regions on the first surface of the recording medium in order in a transport direction and controls a strength of reforming processing to be a reference strength which is set for the recording medium with respect to the target region of a non-image section.

12 Claims, 8 Drawing Sheets

(56) References Cited

U.S. PATENT DOCUMENTS

| | | | | |
|---|---|---|---|---|
| 2012/0069122 | A1* | 3/2012 | Klenkler | G03G 15/286<br>347/151 |
| 2012/0141181 | A1* | 6/2012 | Bisaiji | G03G 15/168<br>399/390 |
| 2012/0201584 | A1* | 8/2012 | Maeda | G03G 15/201<br>399/336 |
| 2016/0056615 | A1* | 2/2016 | Gydesen | B29C 59/10<br>427/535 |

* cited by examiner

IMAGE FORMING APPARATUS AND SURFACE PROCESSING APPARATUS

CROSS-REFERENCE TO RELATED APPLICATIONS

This application is based on and claims priority under 35 USC 119 from Japanese Patent Application No. 2015-032838 filed Feb. 23, 2015.

BACKGROUND

Technical Field

The present invention relates to an image forming apparatus and a surface processing apparatus.

SUMMARY

According to an aspect of the invention, there is provided an image forming apparatus including:

an image forming section that forms a toner image according to image data on a transported recording medium;

a reforming section that generates a polar group on a first surface of the recording medium on which the toner image is formed; and a control section that sets target regions on the first surface of the recording medium in order in a transport direction and controls a strength of reforming processing to be a reference strength which is set for the recording medium with respect to the target region of a non-image section.

BRIEF DESCRIPTION OF THE DRAWINGS

Exemplary embodiments of the present invention will be described in detail based on the following figures, wherein.

DETAILED DESCRIPTION

Figure 1:
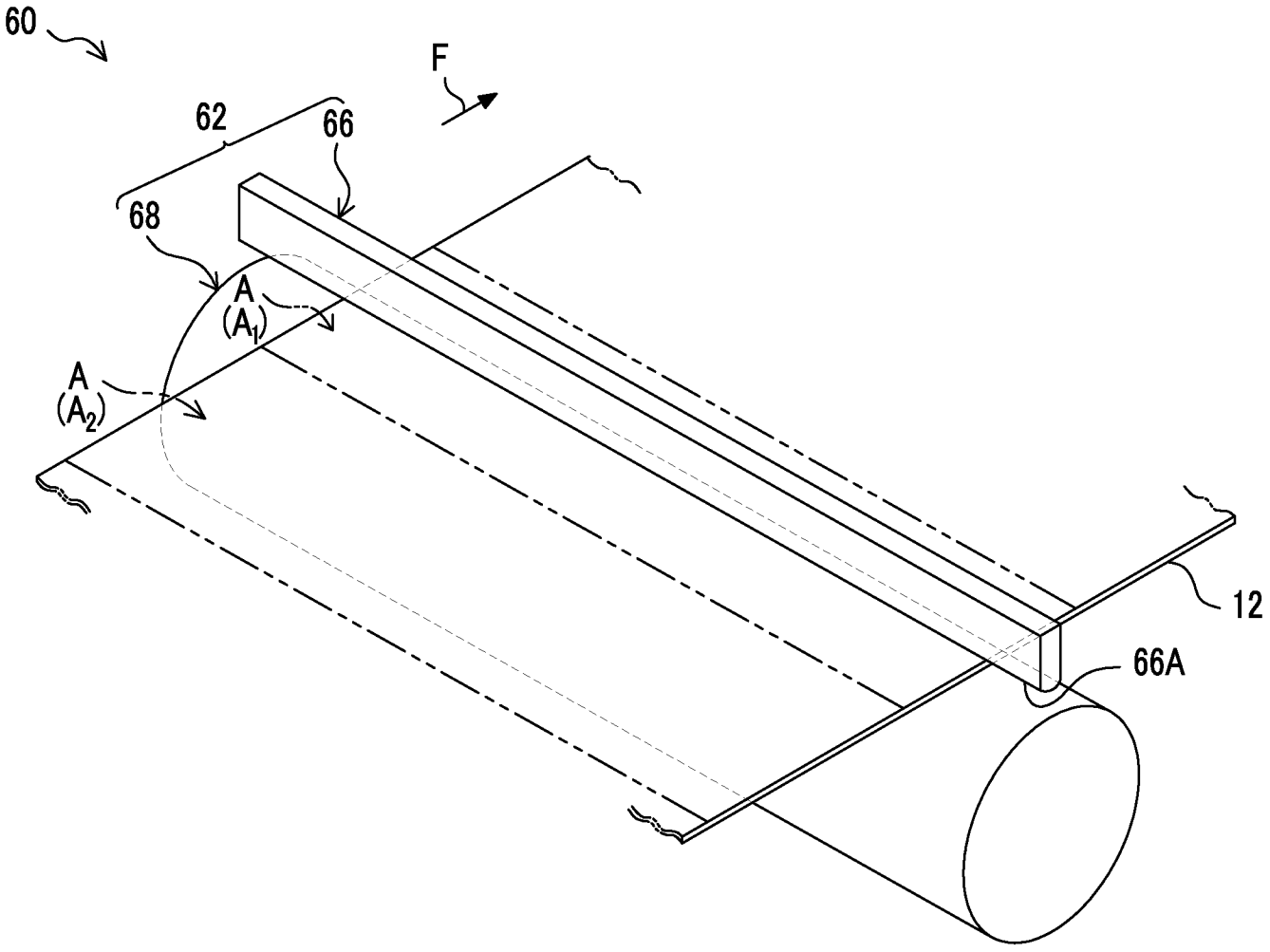
FIG. 1 is a perspective diagram which shows main parts of a corona discharging section according to a first exemplary embodiment.

Detailed description will be given below of the present exemplary embodiment. The coating processing property, adhesion, and writeability of a recording medium are improved by a polar group being generated on the surface thereof. In the present exemplary embodiment, reforming processing is performed in which an image forming base on which an image is formed is set as a target and a polar group is generated on the surface thereof.

In the present exemplary embodiment, a plastic film (a synthetic resin film, referred to below as a film) is used as an example of a recording medium. As the film which is used as the recording medium, for example, various types of synthetic resins such as polyolefin-based resins such as polypropylene (PP), polyethylene (PE), or polyethylene-terephthalate (PET) are used. In addition, without being limited to those described above, synthetic resins such as polyester, polystyrene, or polyvinylalcohol may be used as the film. In the present exemplary embodiment, PET is used as an example of the film. Here, the film may have a single layer structure or may have a multi-layer structure in which plural films are laminated.

In addition, the recording medium preferably has high compatibility with the developer which is used for image forming. As long as this condition is satisfied, the recording medium may be various types of paper sheets such as paper sheets (paper), paper sheets which include cellulose fibers or the like, or coated paper in which various types of coating layers are formed on paper sheets, without being limited to a film.

For example, the wettability, writeability, and the like of a film are increased by performing reforming processing which generates a polar group by reforming the surface and good adhesion is also obtained due to the wettability being increased. Surface reforming methods for a processing target which includes a polymer component such as a film include corona discharging processing, low pressure plasma processing, atmospheric glow discharging, blaze processing, ultraviolet processing, electronic beam processing, and the like. A configuration which corresponds to any of the methods described above is utilized as the reforming section. In the present exemplary embodiment, corona discharging processing is utilized as an example out of these methods.

In the surface reforming, energy is imparted by causing electrons, cations, anions, or ozone, which are generated by setting the atmosphere (air) in the vicinity of the surface of the processing target to a plasma state, to react with the surface of the processing target. By the energy being imparted, the surface energy is increased in the processing target and a polar group is generated on the surface and activated (reformed). By the reforming processing being performed on the film, a main chain, a side chain, or the like of a surface molecular layer is cut and separated and a polar group such as a carboxyl group (—COOH), a hydroxyl group (—OH), or a carbonyl group (>CO) is generated on the surface. The generated polar group is different according to the material of the film, but it is known that the surface of the film is activated by the polar group being generated. For example, the contact angle of water with respect to the film is decreased (becomes small) due to the polar group being generated on the surface of the film. It is possible to represent wettability using the contact angle and the contact angle of water is decreased due to the wettability being increased. The wettability, writeability, and the like are improved by the surface of the film or the like being activated. In addition, by improving the wettability in the film or the like, it is possible to improve the adhesion strength when performing laminating processing which superimposes various types of sheet materials and good lamination is obtained.

An arbitrary developer is used as the developer which is used for forming an image on the recording medium. In the present exemplary embodiment, an image forming apparatus which forms an image according to image data on a film using an electrographic system is utilized as an example and a developer which includes a release agent in addition to a colored toner is used as the developer. The developer may be a one-component developer or may be a two-component developer which uses a carrier or a carrier liquid with a toner. A release agent may be included in the toner or may be included in the carrier or the carrier liquid.

As the release agent, for example, a wax such as a natural wax or a synthetic wax is used. Examples of waxes which are used as a release agent include paraffin wax or microcrystalline wax, which are petroleum waxes, carnauba wax or candelilla wax, which are botanical waxes, and the like. In addition, examples of waxes include beeswax or spermaceti, which are animal-based waxes, polyethylene wax or amide wax, which are synthetic waxes, and the like. In addition, it is also possible to use modifications or mixtures thereof as the wax. It is preferable to select a wax which has an appropriate melting point as the wax in consideration of the softening point of the binder resin of the toner.

In addition, for example, a silicone oil may be used as a release agent. Examples of silicone oils include a dimethyl silicone oil, an alkyl-modified silicone oil, an amino-modified silicone oil, a carboxyl-modified silicone oil, an epoxy-modified silicone oil, a fluorine-modified silicone oil, an alcohol-modified silicone oil, a polyether-modified silicone oil, a methylphenyl silicone oil, a methylhydrogen silicone oil, a mercapto-modified silicone oil, a higher fatty acid-modified silicone oil, a phenol-modified silicone oil, a methacrylic acid-modified silicone oil, a methylstyryl-modified silicone oil, and the like.

First Exemplary Embodiment

Figure 2:
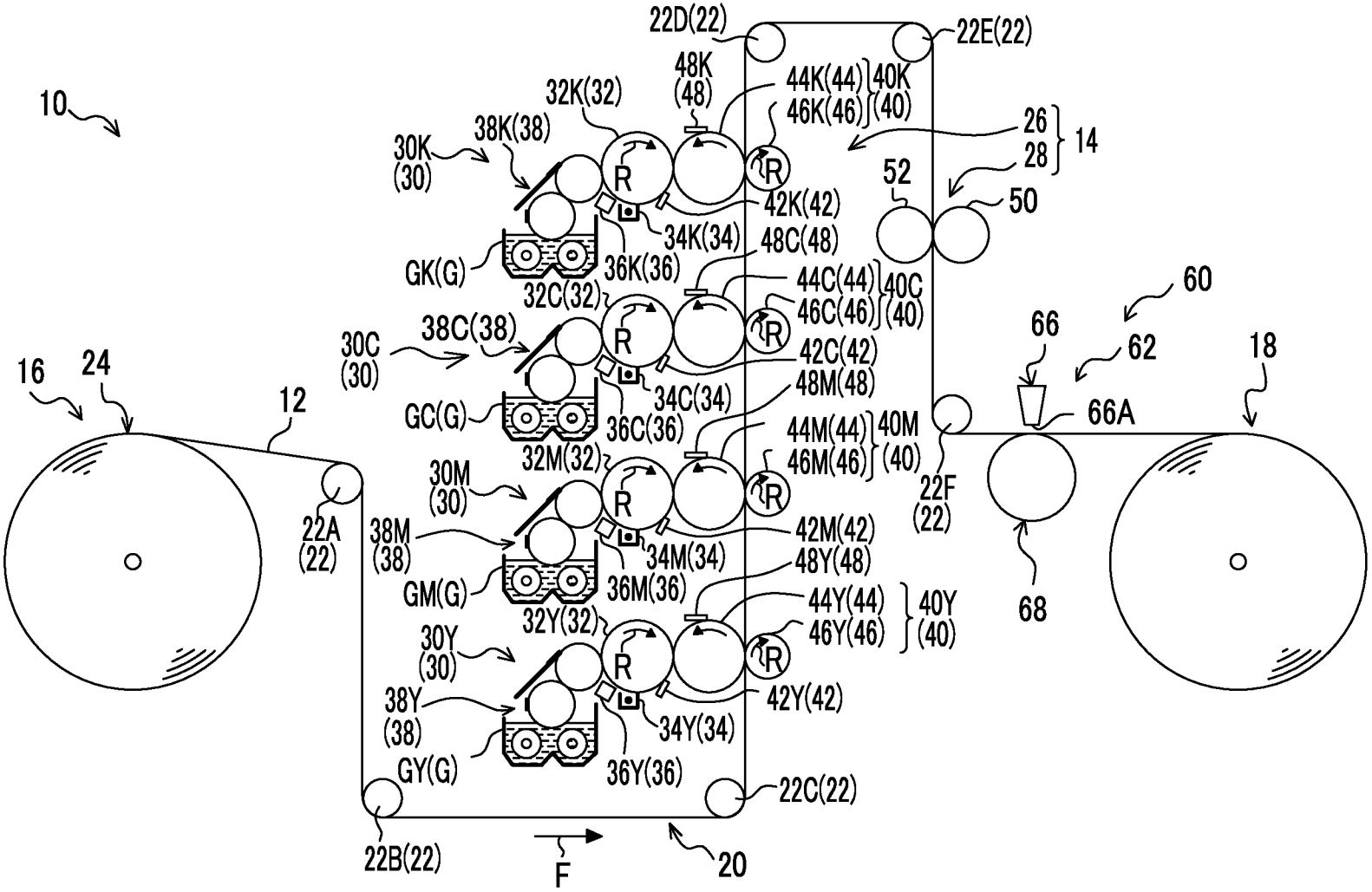
FIG. 2 is a configuration diagram of main parts of an image forming apparatus according to the first exemplary embodiment.

A configuration of main parts of an image forming apparatus 10 according to the first exemplary embodiment is shown in FIG. 2. The image forming apparatus 10 utilizes an electrographic system and forms an image according to image data on a recording medium such as a film 12. Image data may be input to the image forming apparatus 10, for example, from an image processing apparatus or the like which is connected via a communication line such as a dedicated or public network line. In addition, an image reading apparatus which reads an image which is recorded on an original document may be connected with the image forming apparatus 10, and may input image data which is obtained by reading an image which is recorded on the original document from the image reading apparatus thereto. The image forming apparatus 10 forms an image according to image data using a developer on the long film 12 as an example. Here, the long film 12 is utilized below; however, the film 12 may take the form of a sheet without being limited to being long.

The image forming apparatus 10 is provided with an image forming section 14, a supply section 16, and a discharging section 18. In addition, a transport path 20 for the film 12 is formed in the image forming apparatus 10. Plural transport rollers 22 (as an example, transport rollers 22A, 22B, 22C, 22D, 22E, and 22F are shown in FIG. 2 and are referred to below as the transport rollers 22 where no distinction is made between the transport rollers) are arranged in the transport path 20. In the first exemplary embodiment, the transport path 20 and the transport rollers 22 function as an example of a transport section. The film 12 is transported along the transport path 20 at a transport speed which is set in advance by at least a part of the transport rollers 22 being rotated and driven (the transport direction is shown by the direction of the arrow F).

A film roll 24 on which the long film 12 is wound in a roll form is loaded into the supply section 16. The film 12 is drawn out from a peripheral end of the film roll 24 which is loaded into the supply section 16, sent to the transport path 20, and transported to the discharging section 18 via the image forming section 14 from the supply section 16 on the transport path 20.

The image forming section 14 is provided with a developing section 26 which forms an image on the film 12 and a fixing section 28 which is provided on the downstream side of the developing section 26 and which fixes the image which is formed on the film 12 onto the film 12. As an example, the image forming section 14 which is provided in the image forming apparatus 10 forms a color image on the film 12 using developers G (GY, GM, GC, and GK) for each color of Y, M, C, and K. Here, in the description below, the reference letter Y indicates a part for yellow, the reference letter M indicates a part for magenta, the reference letter C indicates a part of cyan, and the reference letter K indicates a part for black.

The developing section 26 is provided with an image forming unit 30Y which uses the developer GY which includes a Y color toner, an image forming unit 30M which uses the developer GM which includes an M color toner, and an image forming unit 30C which uses the developer GC which includes a C color toner as image forming units 30. In addition, the developing section 26 is provided with an image forming unit 30K which uses the developer GK which includes a K color toner as the image forming unit 30. The image forming units 30Y, 30M, 30C, and 30K are arranged along the transport path 20 in the developing section 26.

The image forming units 30 (30Y, 30M, 30C, and 30K) are provided with photoreceptors 32 (32Y, 32M, 32C, and 32K), charging units 34 (34Y, 34M, 34C, and 34K), and exposure units 36 (36Y, 36M, 36C, and 36K). In addition, the image forming units 30 (30Y, 30M, 30C, and 30K) are provided with developing units 38 (38Y, 38M, 38C, and 38K), transferring units 40 (40Y, 40M, 40C, and 40K), and cleaners 42 (42Y, 42M, 42C, and 42K). Here, the developers G to be used are different for the image forming units 30Y, 30M, 30C, and 30K; however, the basic configuration is the same and the reference letters Y, M, C, and K which indicate the colors will be omitted when describing the basic configuration below.

The photoreceptors 32 are formed with cylindrical shapes as an example and hold an electrostatic latent image on peripheral surfaces thereof. In addition, the photoreceptors 32 are rotated in a direction (the direction of the arrow R in FIG. 2) which is determined in advance according to the transport speed of the film 12 which is transported on the transport path 20. In the image forming unit 30, the charging units 34, the exposure units 36, the developing units 38, the transferring units 40, and the cleaners 42 are arranged in order in the rotating direction of the photoreceptors 32 at the periphery of the photoreceptors 32 and each is opposed to the peripheral surface of the photoreceptors 32.

For example, a corotron, a scorotron, or the like is used for the charging units 34 and charges the peripheral surface of the opposing photoreceptors 32 by applying a charging voltage which is determined in advance. The exposure units 36 scan and irradiate the peripheral surfaces of the charged photoreceptors 32 with light beams emitted according to the image data.

Figure 3:
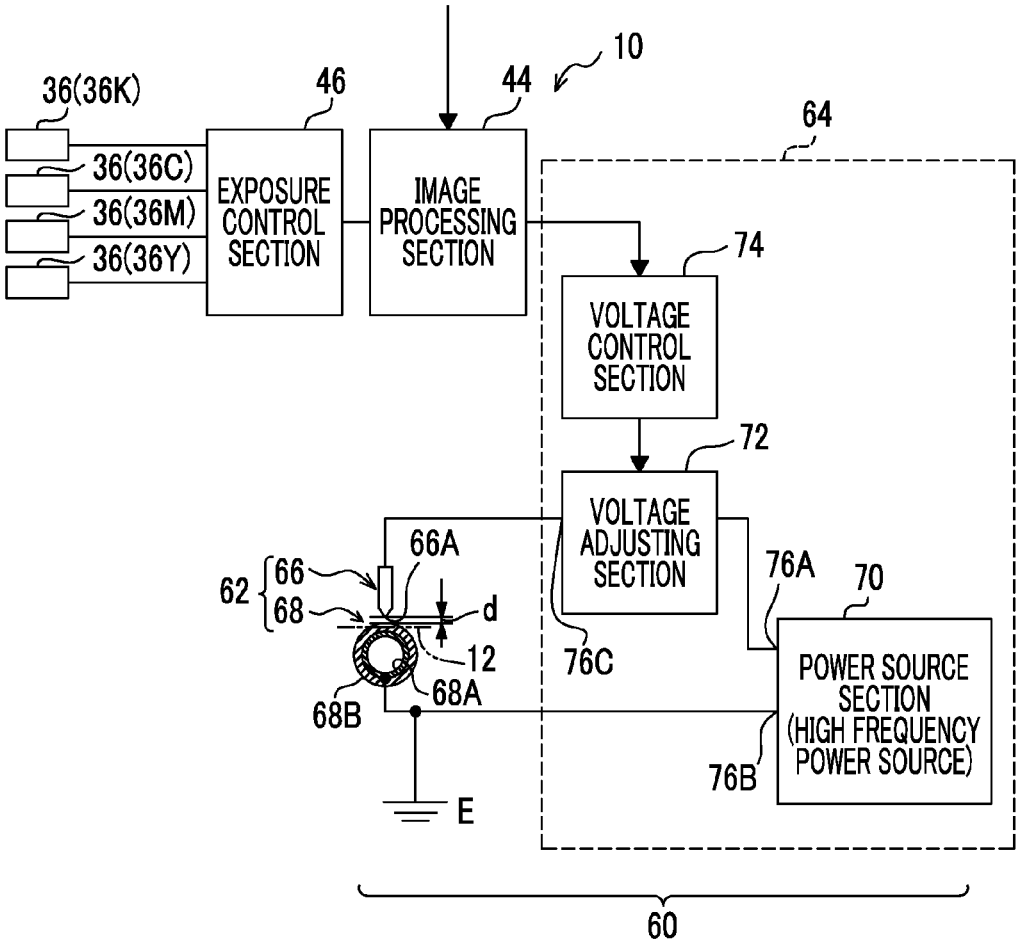
FIG. 3 is a block diagram of main parts of a corona discharging apparatus according to the first exemplary embodiment.

As shown in FIG. 3, the control section which controls the operation of the image forming apparatus 10 is provided with an image processing section 44 and an exposure control section 46. The image forming apparatus 10 is provided with a computer (which is not shown in the diagram) in which a central processing unit (CPU), a random access memory (RAM), a read only memory (ROM), a non-volatile memory such as a hard disk drive (HDD), and the like are connected by a bus. The CPU makes the computer function as the image processing section 44 and the exposure control section 46 by executing an image processing program and an exposure control program which are stored in the non-volatile memory. Here, the image processing program, the exposure control program, and the like executed by the CPU may be stored in a storage medium such as a CD-ROM or a DVD and executed by reading the CD-ROM or DVD with a CD-ROM drive, a DVD drive, or the like which is connected with the computer. In addition, the computer may acquire and execute the image processing program, the exposure control program, and the like to be executed by the CPU via a communication line.

The image processing section 44 executes image processing which is determined in advance on the image data. In addition, the image processing section 44 performs color separation with respect to the image data, generates, for example, raster data (bitmap data) of each color of Y, M, C, and K, and outputs the generated raster data to the exposure control section 46. The exposure control section 46 controls the exposure units 36Y, 36M, 36C, and 36K based on the raster data of each color of Y, M, C, and K in synchronization with the transporting of the film 12. Due to this, an electrostatic latent image according to the image of the Y color component of the image data is formed on the photoreceptor 32Y shown in FIG. 2 and an electrostatic latent image according to the image of the M color component of the image data is formed on the photoreceptor 32M. In addition, an electrostatic latent image according to the image of the C color component of the image data is formed on the photoreceptor 32C and an electrostatic latent image according to the image of the K color component of the image data is formed on the photoreceptor 32K.

The developing units 38 form a toner image according to the electrostatic latent images on the peripheral surfaces of the photoreceptors 32 by supplying the developers G to the peripheral surfaces of the photoreceptors 32 on which the electrostatic latent images are formed. Due to this, a toner image of the Y color component is formed on the photoreceptor 32Y, a toner image of the M color component is formed on the photoreceptor 32M, a toner image of the C color component is formed on the photoreceptor 32C, and a toner image of the K color component is formed on the photoreceptor 32K.

The transferring units 40 are provided with intermediate transfer rollers 48 (48Y, 48M, 48C, and 48K) and transfer rollers 50 (50Y, 50M, 50C, and 50K). The peripheral surfaces of the intermediate transfer rollers 48 are in contact with the peripheral surfaces of the photoreceptors 32 at positions (primary transfer positions) which are set in advance further downstream in the rotating direction of the photoreceptors 32 than the developing units 38, and the intermediate transfer rollers 48 follow and rotate with the photoreceptors 32. In addition, the intermediate transfer rollers 48 are arranged such that the peripheral surfaces contact with the film 12 which is transported on the transport path 20 at a secondary transfer position on the opposite side to the primary transfer position. The transfer rollers 50 are arranged so as to oppose the intermediate transfer rollers 48 interposing the transport path 20 at the secondary transfer position and rotated (rotated in the direction of the arrow R) so as to send out the film 12.

In the image forming units 30, by a primary transfer voltage being applied to the intermediate transfer rollers 48 from a power source apparatus which is not shown in the diagram, the toner images which are formed on the photoreceptors 32 are primarily transferred onto the peripheral surfaces of the intermediate transfer rollers 48 at the primary transfer position. In addition, in the image forming units 30, by a secondary transfer voltage being applied to the transfer rollers 50 from a power source apparatus which is not shown in the diagram, the toner images which are transferred onto the intermediate transfer rollers 48 are transferred onto the film 12 at the secondary transfer position.

By overlapping and transferring toner images which are formed by the image forming units 30Y, 30M, 30C, and 30K of each color on the film 12 in the developing section 26, a toner image (a color toner image) according to the image data is formed on the film 12. The toner image in the present exemplary embodiment functions as an example of a toner image. Here, the cleaners 42 remove residual toner from the peripheral surfaces of the photoreceptors 32 where the primary transfer is finished. In addition, by the secondary transfer being finished, residual toner is removed from the peripheral surfaces of the intermediate transfer rollers 48 by the cleaners 42 (42Y, 42M, 42C, and 42K).

The fixing section 28 is provided with a fixing roller 54 and a pressure roller 56. The fixing roller 54 is heated by a heating section which is not shown in the diagram and the peripheral surface thereof is maintained at a fixing temperature which is set in advance. By the film 12 onto which a toner image is transferred being sent into the fixing section 28, the film 12 is interposed by the fixing roller 54 and the pressure roller 56 and pressure is applied thereto while the film 12 is heated. Due to this, the toner image is fixed and the film 12 is sent out. An image according to the image data is formed by fixing the toner images and the film 12 is wound in a roll form and accommodated in the discharging section 18. Here, it is possible to utilize a configuration known in the art which utilizes an electrographic system in the image forming apparatus 10 and detailed description thereof will be omitted.

Here, a corona discharging apparatus 60 is provided in the image forming apparatus 10. The corona discharging apparatus 60 in the first exemplary embodiment functions as an example of a reforming section. An example of the corona discharging apparatus 60 is shown in FIG. 3. As shown in FIG. 3, the corona discharging apparatus 60 is provided with a corona discharging section 62 and a discharge control section 64. As shown in FIG. 2, in the corona discharging apparatus 60, the corona discharging section 62 is arranged further to the downstream side than the fixing section 28 and further to the upstream side than the discharging section 18. An example of the corona discharging section 62 is shown in FIG. 1. As shown in FIG. 1 and FIG. 2, as a pair of electrodes, the corona discharging section 62 is provided with a discharging electrode 66 on a cathode side and an electrode roller 68 on an anode side which is opposed to the discharging electrode 66 and which functions as an opposite electrode. The discharging electrode 66 is opposed to the surface having the image formed thereon of the film 12 which is transported on the transport path 20 (referred to below as the front surface) and the electrode roller 68 is opposed to the surface on the opposite side to the front surface of the film 12 (referred to below as the rear surface).

As shown in FIG. 3, as an example, a roller main member 68A is formed with a cylindrical shape in the electrode roller 68 using an electrode material known in the art such as stainless steel or aluminum. In addition, a dielectric member layer 68B which uses a dielectric member such as an epoxy resin, a silicone rubber, or a ceramic is formed on a peripheral surface of the roller main member 68A as an example, and the electrode roller 68 is covered by the dielectric member layer 68B. The electrode roller 68 is arranged such that an axis line direction thereof is along the width direction of the film (a direction which intersects the transport direction). The film 12 on which an image is formed is transported while the rear surface is in contact with the peripheral surface of the electrode roller 68.

The discharging electrode 66 is formed with a bar shape with a length which is determined in advance, for example, using an electrode material known in the art such as stainless steel or aluminum. As shown in FIG. 1, the discharging electrode 66 is arranged such that the longitudinal direction thereof is along the width direction of the film 12, that is, the axis line direction of the electrode roller 68. In addition, the length of the discharging electrode 66 is longer than the width direction dimension of the film 12 and the electrode roller 68 has a length in the axis line direction in accordance with the length of the discharging electrode 66. Due to this, the discharging electrode 66 and the electrode roller 68 are opposed to the entirety of the film 12 in the width direction.

The width dimension of the discharging electrode 66 on the electrode roller 68 side is narrowed toward the electrode roller 68 in a cross-section along a direction which intersects with the longitudinal direction of the discharging electrode 66 as an example, and a front end section 66A which protrudes so as to be convex toward the front surface of the film 12 is formed.

As shown in FIG. 3, the front end section 66A of the discharging electrode 66 and the peripheral surface of the electrode roller 68 are arranged at an interval d (gap) which is set in advance, and the corona discharging section 62 is formed such that a corona discharge is generated from the front end section 66A of the discharging electrode 66 toward the electrode roller 68. As the interval d, it is possible to utilize an interval which allows appropriate generation of a corona discharge and for example, a value which is set in advance in a range of d=1 mm to 2 mm is utilized.

The discharge control section 64 is provided with a power source section 70, a voltage adjusting section 72, and a voltage control section 74. In the first exemplary embodiment, the power source section 70 and the voltage adjusting section 72 function as a discharge power source and the voltage control section 74 functions as a control section.

A so-called high frequency power source is used for the power source section 70 and the power source section 70 generates alternating current (AC) power with a frequency and a voltage which are determined in advance (for example, AC power in a range in which the frequency is 5 kHz or more to 100 kHz or less and the voltage is 1 kvp-p or more to 100 kvp-p or less). The power source section 70 is provided with a pair of output terminals 76A and 76B and the generated AC power is output from the output terminals 76A and 76B.

In the power source section 70, the output terminal 76A is connected with the voltage adjusting section 72, and the output terminal 76B is grounded and connected with the roller main member 68A of the electrode roller 68. In addition, the voltage adjusting section 72 is provided with an output terminal 76C and the output terminal 76C is connected with the discharging electrode 66. The voltage adjusting section 72 adjusts the voltage of the AC power which is input from the power source section 70 and outputs the AC power from the output terminal 76C. Due to this, the voltage of the AC power which is generated in the power source section 70 is adjusted in the voltage adjusting section 72 and the AC power is applied to the discharging electrode 66 with a discharge voltage Vd.

The corona discharging apparatus 60 generates a corona discharge from the discharging electrode 66 to the electrode roller 68 by applying the discharge voltage Vd to the discharging electrode 66. In addition, the corona discharging apparatus 60 activates the front surface of the film 12 which opposes the discharging electrode 66 by generating the corona discharge and reforms the front surface of the film 12.

A computer (which is not shown in the diagram) where, for example, a CPU, a RAM, a ROM, a non-volatile memory, and the like are connected by a bus is used for the discharge control section 64. In the discharge control section 64, the computer functions as the voltage control section 74 by the CPU reading and executing a discharging control program which is stored in the non-volatile memory. Here, a computer is used for the image processing section 44 and the like in the image forming apparatus 10 and the function of the voltage control section 74 of the corona discharging apparatus 60 may be executed by the computer which is provided in the image forming apparatus 10. In addition, the discharging control program executed by the CPU may be stored in a storage medium such as a CD-ROM or DVD and the CD-ROM or DVD may be read and executed by a CD-ROM drive, a DVD drive, or the like which is connected with the computer. In addition, the computer may acquire and execute the discharging control program to be executed by the CPU via a communication line. Furthermore, the voltage control section 74 may be configured by hardware without being limited to a configuration which functions according to software executed by a computer.

The voltage control section 74 is connected with the voltage adjusting section 72 and the image processing section 44 of the image forming apparatus 10. The voltage control section 74 acquires data which shows an image which is formed on the film 12 from the image processing section 44. It is sufficient if the acquired data shows the image which is formed on the film 12 and the acquired data may be image data or raster data (bitmap data) and will be referred to below as image data.

The voltage control section 74 sets the discharge voltage Vd according to the image which is formed on the film 12 based on the acquired image data. The voltage control section 74 controls the voltage adjusting section 72 such that the set discharge voltage Vd is output.

In the first exemplary embodiment, reforming processing is performed on the front surface of the film 12 by corona discharging processing. In addition, in the first exemplary embodiment, the strength of the reforming processing with respect to the front surface of the film 12 is adjusted by adjusting the strength of the corona discharge according to the image which is formed on the film 12. The adjustment of the strength of the reforming processing in the first exemplary embodiment is to differentiate between an image section which includes the image which is formed using a toner on the film 12 and a non-image section which does not include the image.

The corona discharging apparatus 60 performs corona discharging processing with respect to the film 12 which is transported at a transport speed which is determined in advance. From here, as shown in FIG. 1, the voltage control section 74 according to the first exemplary embodiment sets regions A with a size which is determined in advance on the film 12 which is the processing target so as to be continuous in the transport direction and in order in the transport direction. That is, the voltage control section 74 sets the regions A ($A_1$, $A_2$, . . . ) so as to divide the film 12 into plural regions in the transport direction. In the first exemplary embodiment, the regions A function as an example of the target regions. In addition, the voltage control section 74 sets the discharge voltage Vd for each of the set regions A.

In the first exemplary embodiment, the regions A are regions on the film 12 which oppose the discharging electrode 66 and the electrode roller 68 and each of the regions A includes the entirety of the film 12 in the width direction. In addition, the length of each of the regions A in the transport direction is set, for example, based on the control time of the discharge voltage Vd, the transport speed of the film 12, and the like.

The voltage control section 74 shown in FIG. 3 determines whether or not an image (a toner image) is included for each of the regions A which are set on the film 12 based on the image data, and sets the regions A which do not include an image as non-image sections and the regions A which include an image as image sections. The voltage control section 74 sets the discharge voltage Vd with respect to the regions A which are non-image sections to a voltage $Vd_f$ which is determined with respect to the film 12 itself ($Vd=Vd_f$). The voltage $Vd_f$ is a voltage which is set so as to be able to set an appropriate front surface reforming state with respect to the front surface of the film 12 on which a toner image is not formed. The voltage $Vd_f$ in the first exemplary embodiment functions as an example of a reference strength.

In addition, the developers G which include a release agent are used for the image forming on the film 12 and from here, the voltage control section 74 sets the discharge voltage Vd with respect to the regions A which are determined as image sections to the voltage $Vd_f$ or higher ($Vd \geq Vd_f$). Setting the discharge voltage Vd to $Vd_f$ or higher in the first exemplary embodiment functions as an example of setting the reforming strength of the image sections to the reference strength and functions as an example of increasing the strength of the reforming section. At that time, the voltage control section 74 sets the discharge voltage Vd according to the formed image for the regions A which are determined as image sections. Specifically, the voltage control section 74 obtains an image density Pd which is an index of an area of the image portion (or the area of a non-image portion) which is formed in the regions A based on the image data. For example, the dot density (or the pixel density) which uses the number of dots (or the number of pixels) for each unit area is utilized as the image density Pd. In addition, it is sufficient if the image density Pd shows the ratio of an exposed area of the front surface of the film 12 in the regions A and an area (a non-exposed area) which is covered by a developer (a toner) and, for example, the area of the image for each unit area (the area of the image in the regions A with respect to an area of the regions A, or the pattern area ratio) or the like may be used.

Figure 4:
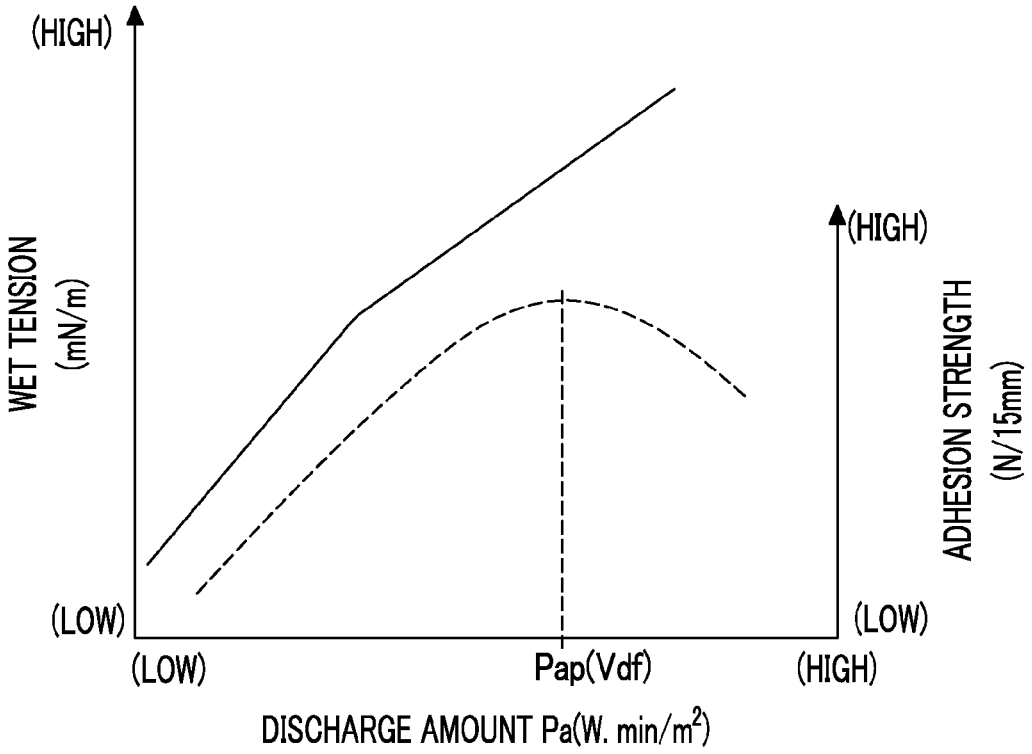
FIG. 4 is a line diagram which shows an example of changes in wet tension and adhesion strength with respect to a discharging amount.

FIG. 4, for example, shows an example of the results of measuring adhesion strength and wet tension with respect to a discharging amount Pa when corona discharging processing is performed with respect to the PET film 12. Here, the discharging amount Pa in the corona discharging processing is determined as $Pa=P/(L \times v)$ from discharging power P (Watt: discharge voltage Vd×discharge current), a transport speed v (m/min) of the film 12, and a discharging electrode length L (m). A sample with a width of 15 mm is cut out from the film 12 on which the corona discharging processing is performed and measurement results based on a method for measuring T type detachment strength which is regulated by JISK6854-3 with regard to the sample are utilized for the adhesion strength. In addition, measurement results based on a test method which is regulated by JISK6768 are utilized for the wet tension.

As shown in FIG. 4, by the discharging amount Pa being increased, the wet tension of the film 12 is increased along with the increases in the discharging amount Pa. In contrast to this, the adhesion strength of the film 12 is increased due to the discharging amount Pa being increased; however, when the discharging amount Pa exceeds a value ($Pa_p$) which is determined according to the material of the film 12, the adhesion strength decreases in accordance with the increases in the discharging amount Pa.

Here, in the first exemplary embodiment, the voltage $Vd_f$ at which a discharging amount $Pa_p$ where the adhesion strength of the film 12 is at a peak is obtained is utilized as the discharge voltage Vd with respect to the non-image sections of the film 12.

In addition, for the regions (the regions which include an image) A to which toner is attached on the film 12, in order to obtain the desired wettability, writeability, and the like (for example, hydrophilicity or the like), the voltage is set to a higher voltage than the voltage $Vd_f$ for the regions A where an image is not formed on the film 12 (the regions of the non-image sections). That is, the energy which is necessary for the activation is different between the image sections and the non-image sections and it is necessary to set the energy which is imparted to the image sections to be greater than the energy which is imparted to the non-image sections in order to be able to obtain wettability, writeability, and the like which do not change between the non-image sections and the image sections. From here, compared to the regions A which include the image which is formed by a developer which includes a release agent, the reforming processing is more strongly performed on the regions A on which an image is not formed.

From here, in the first exemplary embodiment, the discharge voltage Vd in a case where the regions A which are set on the film 12 are image sections is set to be higher than the discharge voltage Vd ($Vd=Vd_f$) in a case where the regions A are non-image sections to increase the discharging amount Pa. In addition, in the first exemplary embodiment, a voltage $Vd_{max}$ is set with respect to the region on which a so-called solid image of which the image density Pd is the highest is formed and the discharge voltage Vd is set with respect to the regions A of image sections according to the image density Pd in a range from the voltage $Vd_f$ to the voltage $Vd_{max}$ ($Vd_f < Vd \leq Vd_{max}$).

In the corona discharging apparatus 60, in order to obtain a discharging amount Pa according to the image density Pd of the film 12, a table of the discharge voltage Vd with respect to the image density Pd is set in advance and stored in a non-volatile memory (not shown in the diagram) of the voltage control section 74. The voltage control section 74 calculates the image density Pd for each of the regions A on the film 12 based on the image data and sets the discharge voltage Vd according to the calculated image density Pd. Here, the table of the discharge voltage Vd with respect to the image density Pd divides a range from the minimum value to the maximum value of the image density Pd into ranges which are determined in advance and divides the image density Pd into plural sections. In addition, a table in which appropriate discharge voltages Vd ($Vd_f < Vd \leq Vd_{max}$) which correspond to the image density Pd in each of the divided sections and the like are set is used for the table.

Description will be given below of the corona discharging processing by the corona discharging apparatus 60 which is provided in the image forming apparatus 10 as an effect of the first exemplary embodiment.

In the image forming apparatus 10, by the image data of the image which is formed on the film 12 being input, a toner image is generated according to the image data. In addition, the image forming apparatus 10 draws the film 12 from the film roll 24 which is loaded into the supply section 16 and transfers the toner image to the drawn film 12. Furthermore, the image forming apparatus 10 fixes the toner image on the film 12 by heating and applying pressure to the film 12 onto which the toner image is transferred and forms an image according to the image data on the film 12. Here, in the image forming apparatus 10, the developers G which include a release agent are used for the image forming on the film 12 and, due to this, the image which is formed on the film 12 is prevented from being damaged due to toner being attached to the fixing roller 54 or the like in the fixing section 28.

Here, since the film 12 and the image which is formed on the film 12 are low in wettability, writeability, and the like in particular, there is a possibility that the desired wettability, writeability, and the like will not be obtained for the entire surface of the film 12. The image forming apparatus 10 generates a polar group through which the wettability, writeability, and the like are improved by performing reforming processing with respect to the front surface of the film 12 using the corona discharging apparatus 60 which is provided as a reforming section.

Figure 5:
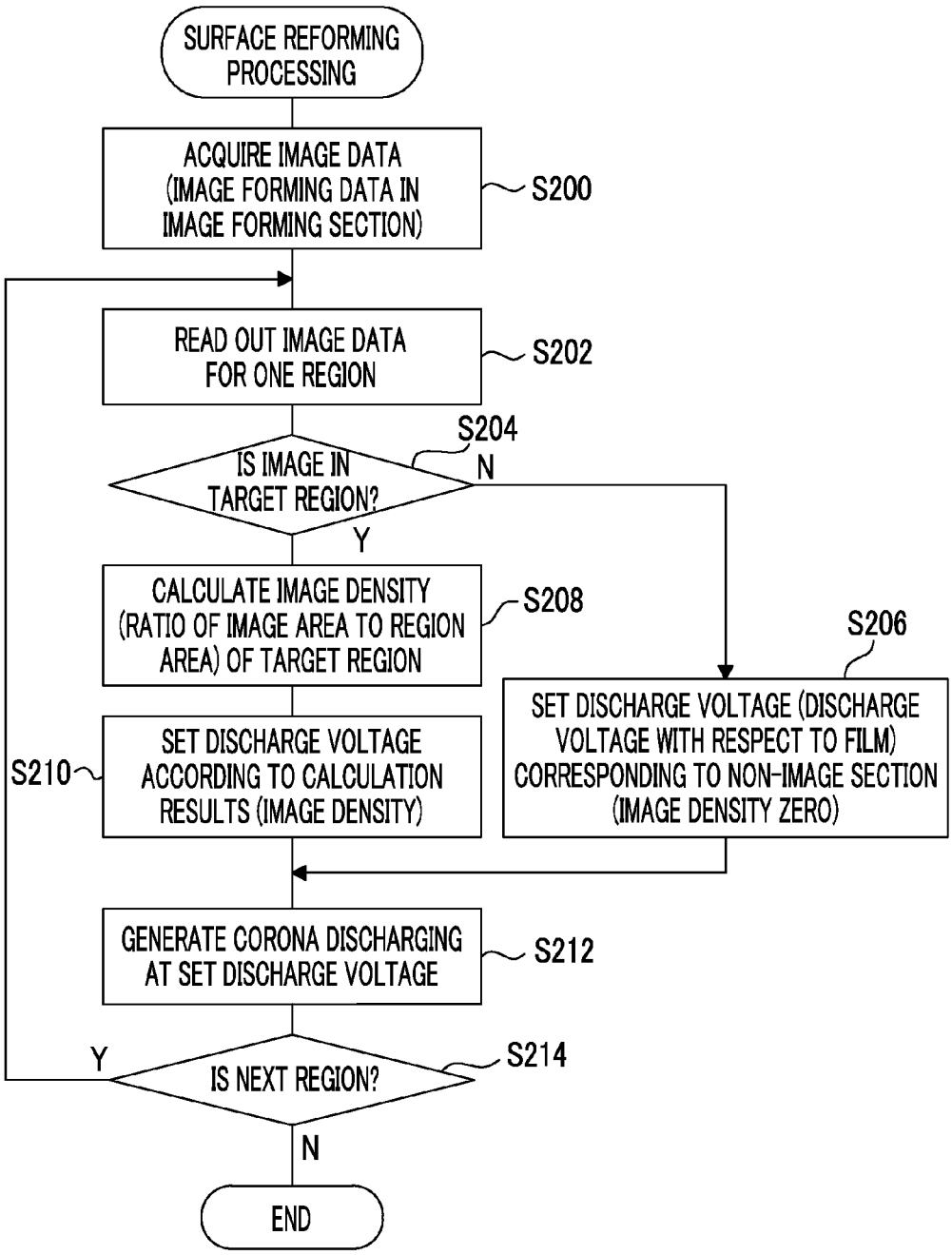
FIG. 5 is a flowchart which shows an example of reforming processing according to the first exemplary embodiment.

FIG. 5 shows an example of reforming processing with respect to the film 12 using the corona discharging apparatus 60. In the flowchart, for example, the process for forming an image on the film 12 is started and executed in synchronization with the transporting of the film 12 and the image data of an image which is formed on the film 12 is read in the initial step 200. In the corona discharging apparatus 60, the regions A with a size which is determined in advance on the front surface of the film 12 (the length in the transport direction is a length which is set in advance) are set in order and the corona discharging processing is performed in order by setting each of the set regions A as a target.

In step 202, image data of one region (one region A) which is set as a target is read out in order from the front end side of the film 12 in the transport direction. In the next step 204, it is confirmed whether an image is formed in the target region A from the read image data. Here, when the target region A is a non-image section in which an image is not formed, a negative determination is made in step 204 and the process proceeds to step 206. In step 206, the voltage $Vd_f$ which is set so as to be able to obtain the desired wettability, writeability, and the like with regard to the non-image sections of the film 12 is set as the discharge voltage Vd for the target region A.

In contrast to this, when the target region A is an image section in which an image is formed, a positive determination is made in step 204 and the process proceeds to step 208. In step 208, the image density Pd of the target region A is calculated based on the image data of the target region A. In the next step 210, a voltage which corresponds to the calculated image density Pd is read out from a table of the image density-voltage (a discharge voltage) stored in a non-volatile memory which is not shown in the diagram and the read voltage is set as the discharge voltage Vd with respect to the target region A.

When the discharge voltage Vd is set in this manner, in step 212, control is carried out such that the corona discharging processing is executed with respect to the target region A with the set discharge voltage Vd in synchronization with the transporting of the film 12. In addition, in step 214, whether or not there are remaining regions A is confirmed and, when there are remaining regions A, a positive determination is made in step 214, the process proceeds to step 202, and the corona discharging processing is executed with respect to the next region A. Due to this, reforming processing is carried out on the front surface of the film 12 while the strength is adjusted according to the presence or absence of the images which are formed for each of the regions A which are set in order in the transport direction.

Here, in the first exemplary embodiment, it is determined whether the region A is an image section or a non-image section and, when determined as a non-image section, the set voltage $Vd_f$ is applied to the film 12 itself and when determined as an image section, a voltage is applied according to the image density Pd; however, the present invention is not limited thereto. For example, the determination of image section or non-image section may be omitted and the image density Pd may be calculated for each region. In addition, the discharge voltage Vd with respect to the image density may be set by being divided into plural ranges (plural sections) in the range from the image density Pd which corresponds to the non-image sections to the image density Pd which corresponds to a solid image and using a table in which an appropriate voltage is set with regard to each of the divided ranges and the like. Due to this, even when the determination of image section or non-image section for the region A is omitted, the voltage $Vd_f$ is set with respect to the region A which corresponds to the non-image sections.

In addition, in the first exemplary embodiment, the strength of the surface reforming is adjusted by controlling the discharge voltage Vd; however, the adjustment of the strength of the reforming processing is not limited thereto. The strength of the reforming processing which utilizes the corona discharging processing is influenced by the discharging amount Pa and the strength of the reforming processing is increased by increasing the discharging amount Pa. In addition, the discharging amount Pa changes according to the discharge current and the discharge current changes according to the interval d between the discharging electrode 66 (the front end section 66A) and the electrode roller 68 in a range in which the corona discharge is generated.

From here, for example, the strength of the reforming processing may be adjusted by making the discharging electrode 66 move toward the electrode roller 68 in a case of increasing the strength of the surface reforming and move away in a case of decreasing the strength of the surface reforming using a lift mechanism (a moving mechanism) which moves in the direction of approach and the direction of separation or which relatively moves. In addition, without being limited thereto, an arbitrary configuration which adjusts the discharging amount Pa in the corona discharging processing may be utilized.

Second Exemplary Embodiment

Next, description will be given of the second exemplary embodiment. Here, in the second exemplary embodiment, the same reference numerals as in the first exemplary embodiment are used for the same functional parts as in the first exemplary embodiment described above and detailed description thereof will be omitted.

Figure 6:
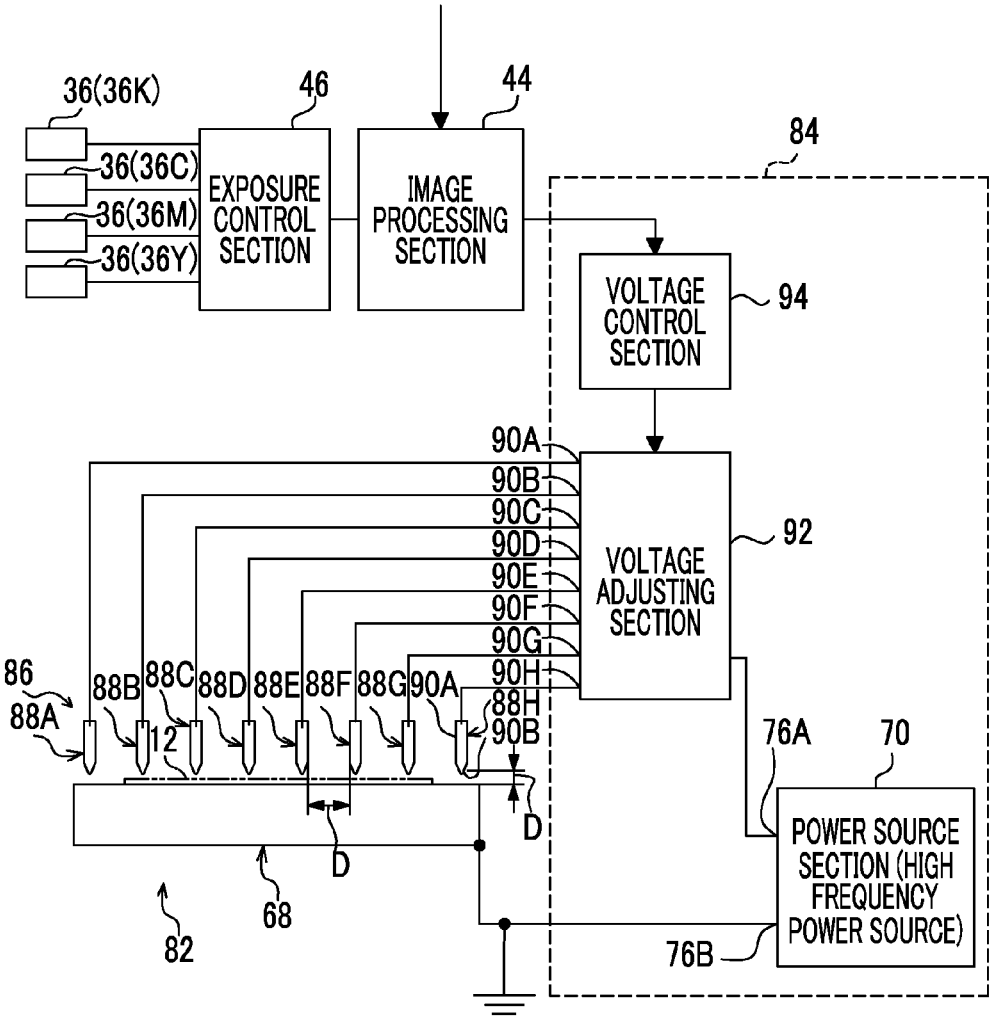
FIG. 6 is a block diagram which shows main parts of a corona discharging apparatus according to a second exemplary embodiment.
Figure 7:
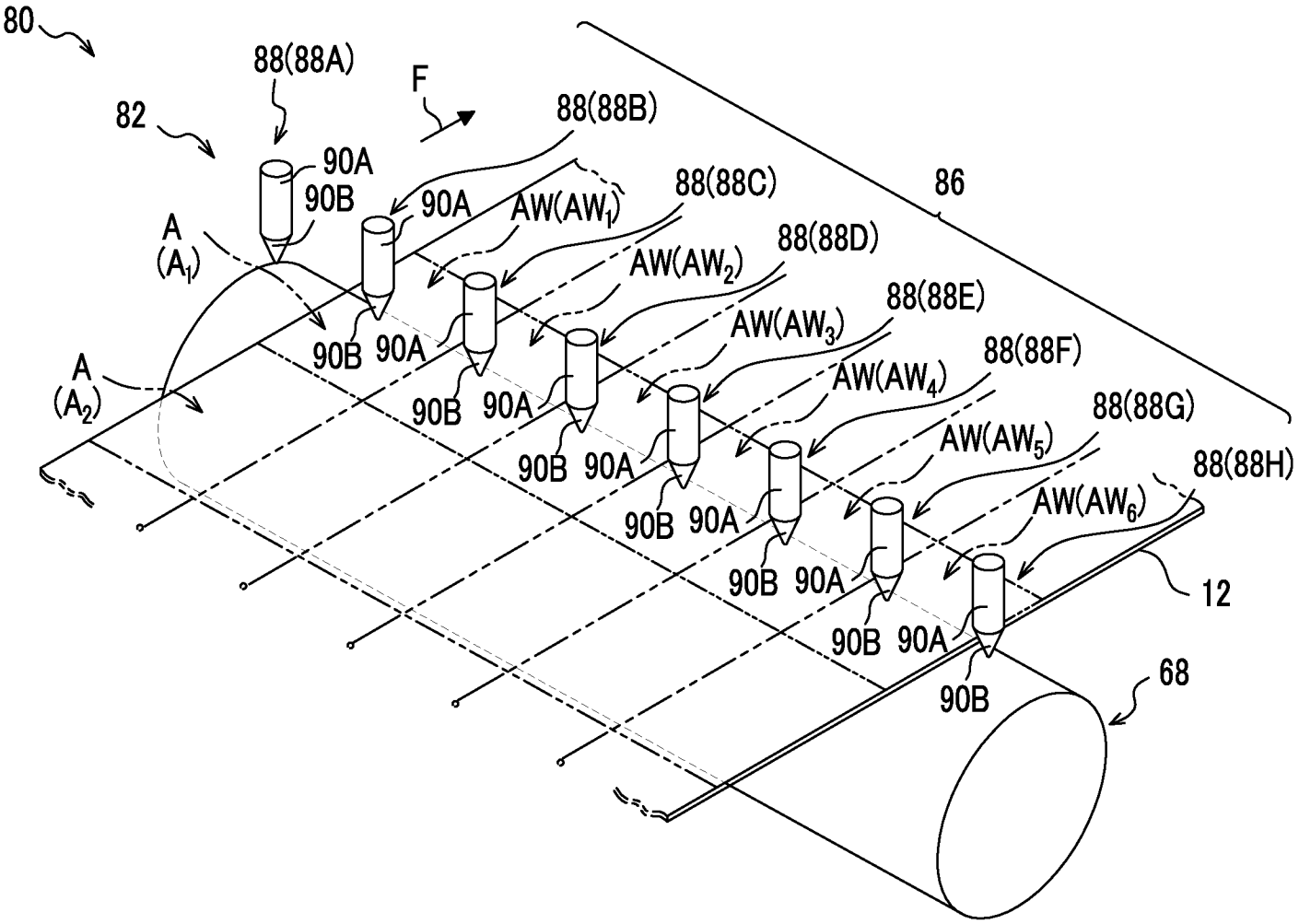
FIG. 7 is a perspective diagram which shows main parts of a corona discharging section according to the second exemplary embodiment.

In the second exemplary embodiment, plural regions which are divided in the width direction of the film 12 are set on the front surface of the film 12 which is the target of the surface reforming and the strength of the surface reforming is adjusted for each of the set regions. FIG. 6 and FIG. 7 show an example of the configuration of main parts of a corona discharging apparatus 80 according to the second exemplary embodiment. The corona discharging apparatus 80 according to the second exemplary embodiment is provided in the image forming apparatus 10 instead of the corona discharging apparatus 60 according to the first exemplary embodiment.

As shown in FIG. 7, the corona discharging apparatus 80 is provided with a corona discharging section 82 and a discharge control section 84. As shown in FIG. 6 and FIG. 7, in the corona discharging section 82, a discharging electrode 86 is used instead of the discharging electrode 66 of the corona discharging section 62 and the discharging electrode 86 and the electrode roller 68 are arranged as a pair.

As shown in FIG. 7, the corona discharging apparatus 80 according to the second exemplary embodiment sets plural regions AW ($AW_1$, $AW_2$, . . . ) by dividing the front surface of the film 12 in the width direction. The plural regions AW are set to be continuous in the width direction of the film 12. The corona discharging apparatus 80 performs surface reforming on the film 12 by performing the corona discharging processing for each of the set regions AW. In addition, the corona discharging apparatus 80 adjusts the discharge voltage Vd which sets the reforming strength of each of the regions AW according to the image which is formed on the film 12.

The discharging electrode 86 which is used for the corona discharging apparatus 80 is provided with plural pin electrodes 88. The pin electrodes 88 in the second exemplary embodiment function as an example of partial electrodes. With regard to the discharging electrode 86, the plural pin electrodes 88 are attached to a base table which is not shown in the diagram and arranged in the width direction of the film 12. With regard to each of the pin electrodes 88, for example, a base section 90A which is abase table side which is not shown in the diagram (the paper surface upper side in FIG. 6) is formed with a columnar shape and the axis line thereof faces the electrode roller 68. In addition, the diameter of a front end section 90B of the pin electrodes 88 which opposes the peripheral surface of the electrode roller 68 is reduced toward the electrode roller 68 side and the front end is, for example, curved with a hemispherical shape. Each of the pin electrodes 88 is arranged such that there is an interval d which is determined in advance between the front end sections 90B and the peripheral surface of the electrode roller 68 and formed such that a corona discharge is generated from the front end sections 90B toward the electrode roller 68.

As shown in FIG. 6, among the pin electrodes 88, an interval D between adjacent pin electrodes 88 is wider than the interval d (D>d). Here, the interval D is the distance between the peripheral surfaces of the pin electrodes 88 which are adjacent to each other. In addition, in the present exemplary embodiment, an insulated state which uses an air layer is created by leaving a space between the pin electrodes 88 which are adjacent to each other; however, without being limited thereto, an insulator or the like may be arranged between the pin electrodes 88 which are adjacent to each other. In addition, a discharge is not generated between the pin electrodes 88 which are adjacent to each other, and the pin electrodes 88 may adopt an arbitrary shape which appropriately generates a corona discharge between the electrode rollers 68.

As shown in FIG. 7, in the corona discharging apparatus 80, the plural pin electrodes 88 correspond to any of plural regions AW on the film 12. The regions AW in the second exemplary embodiment function as an example of a width region. The regions AW are set on the film 12 to match the discharging target regions of the pin electrodes 88. In the second exemplary embodiment, as an example, the film 12 is divided into six in the width direction and the strength of the corona discharging processing is differentiated for each of the divided regions AW ($AW_1$ to $AW_6$). The corona discharging section 82 is provided with eight pin electrodes 88A to 88H as an example and, out of the pin electrodes 88A to 88H, the pin electrodes 88B to 88G are opposed to the regions $AW_1$ to $AW_6$. Due to this, in the corona discharging apparatus 80, by applying the discharge voltage Vd to each of the pin electrodes 88 (88B to 88G), the corona discharging processing is performed with respect to the entire region in the width direction of the film 12 opposed by the discharging electrodes 86.

As shown in FIG. 6, the discharge control section 84 is provided with the power source section 70, a voltage adjusting section 92, and a voltage control section 94. In the second exemplary embodiment, the power source section 70 and the voltage adjusting section 92 function as an example of a discharging power source and the voltage control section 94 functions as an example of a control section. Output terminals 96A to 96H are provided corresponding to the pin electrodes 88A to 88H and the voltage adjusting section 92 sets a voltage which is adjusted for each of the pin electrodes 88A to 88H as the discharge voltage Vd and separately applies this voltage to each of the pin electrodes 88A to 88H.

The voltage control section 94 sets the target regions A in order so as to be continuous in the transport direction of the film 12 and sets the regions AW which are continuous in order in the width direction of the film 12 for each of the regions A (refer to FIG. 7). In addition, the voltage control section 94 acquires image data according to the image which is formed on the film 12 and performs the determination of image section or non-image section based on the image data by setting each of the regions AW which are set in the regions A as a target. In addition, the voltage control section 94 sets the voltage $Vd_f$ as the discharge voltage Vd with respect to the regions AW which are determined as non-image sections. In addition, the voltage control section 94 calculates the image density Pd with respect to the regions AW which are determined as image sections and sets the discharge voltage Vd according to the calculated image density Pd.

After that, the voltage control section 94 carries out control so as to apply the discharge voltage Vd which is set in each of the regions AW of the regions A to the corresponding pin electrodes 88 at a timing when the target regions A on the film 12 pass the corona discharging processing position which opposes the discharging electrode 86 (each of the pin electrodes 88).

On the other hand, the film 12 on which an image which corresponds to the image data is formed by passing through the fixing section 28 passes through the corona discharging processing position which opposes the discharging electrode 86 of the corona discharging apparatus 80 and is sent into the discharging section 18. The voltage control section 94 executes the corona discharging processing in synchronization with the transporting of the film 12. That is, the voltage control section 94 performs the corona discharging processing by applying the discharge voltage Vd which is set for each of the regions AW to each of the pin electrodes 88 (88B to 88G) at a timing when the regions $AW_1$ to $AW_6$ of the film 12 pass through the corona discharging processing position. Due to this, the film 12 is activated so as to be able to obtain the desired wettability, writeability, and the like by the plural regions AW which are set in the width direction undergoing the reforming processing at a strength according to the formed image.

Third Exemplary Embodiment

Next, description will be given of the third exemplary embodiment. Here, in the third exemplary embodiment, the same reference numerals as in the first or second exemplary embodiment are used for the same functional parts as in the first or second exemplary embodiment described above and detailed description thereof will be omitted.

Figure 8:
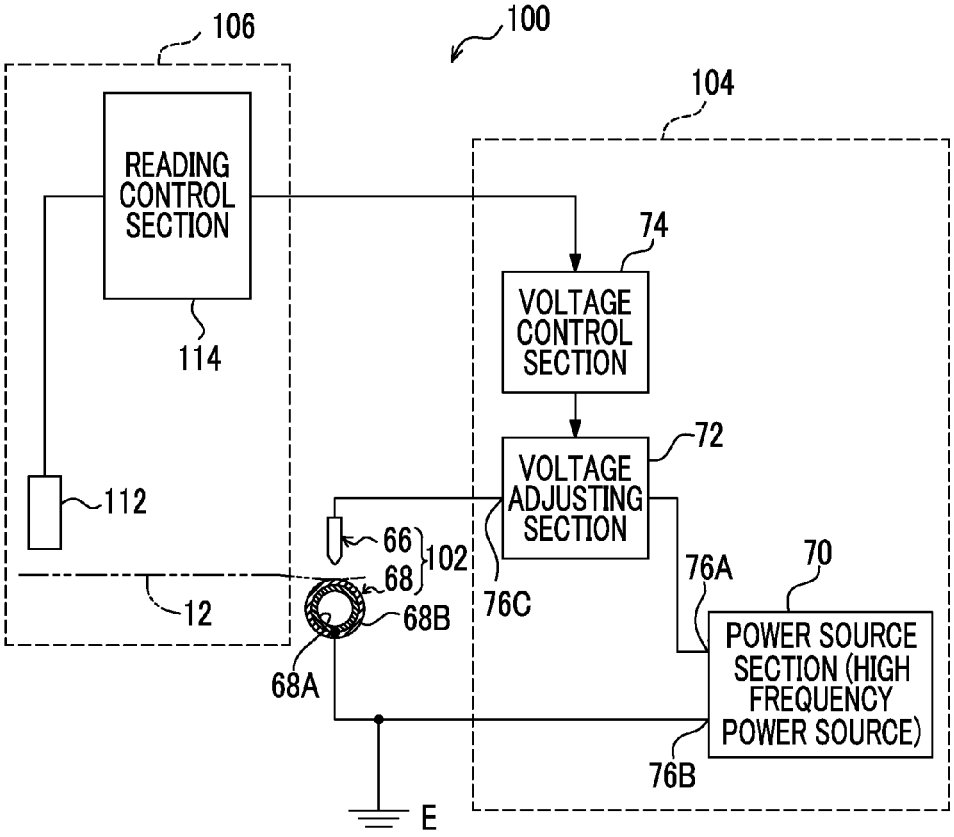
FIG. 8 is a configuration diagram which shows main parts of a corona discharging section of a surface processing apparatus according to a third exemplary embodiment.
Figure 9:
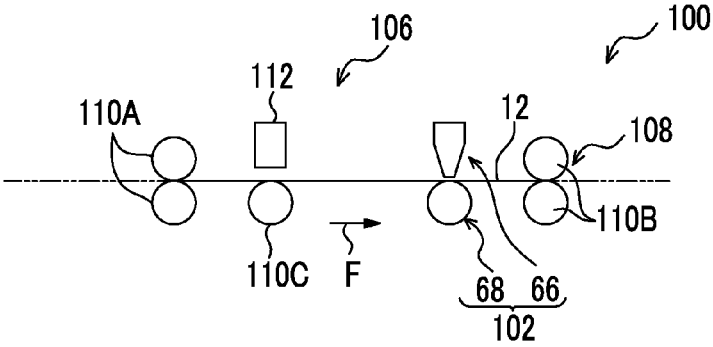
FIG. 9 is a block diagram which shows main parts of a surface processing apparatus according to the third exemplary embodiment.

FIG. 8 and FIG. 9 show an example of the configuration of main parts of a surface processing apparatus 100 according to the third exemplary embodiment. The surface processing apparatus 100 performs surface reforming processing by setting the film 12 which is an example of a recording medium as a processing target. It is more preferable that, for example, an image is formed on the film 12 which is a processing target by using a developer which includes a release agent. The surface processing apparatus 100 may perform surface reforming processing on the film 12 on which an image is formed, for example, by being arranged on the downstream side of an image forming apparatus which is not provided with a surface reforming function. In addition, the surface processing apparatus 100 may be arranged on the upstream side (the front stage) of a laminating apparatus or the like which performs a laminating process on the film 12 on which an image is formed. In the third exemplary embodiment, description will be given with the surface processing apparatus 100 provided on the front stage of a laminating apparatus as an example.

As shown in FIG. 8, the surface processing apparatus 100 is provided with a corona discharging section 102 and a discharge control section 104. In addition, the surface processing apparatus 100 is provided with an image reading section 106. The corona discharging section 102 is provided with the discharging electrode 66 and the electrode roller 68. The discharge control section 104 is provided with the power source section 70, the voltage adjusting section 72, and the voltage control section 74. In addition, the image reading section 106 in the third exemplary embodiment functions as an example of an image reading section.

As shown in FIG. 9, a transport path 108 for the film 12 is formed in the surface processing apparatus 100. On the transport path 108, a pair of transport rollers 110A are provided on the upstream side in the transport direction of the film 12 as an example and a pair of transport rollers 110B are provided on the downstream side in the transport direction. The film 12 is transported by the transport rollers 110A and 110B and sent into a laminating apparatus which is not shown in the diagram. Here, for example, the transport speed of the film 12 in the laminating apparatus is utilized as the transport speed in the transport path 108.

In the surface processing apparatus 100, the corona discharging section 102 is arranged on the transport rollers 110B side, the discharging electrode 66 opposes the front surface (the surface on which the image is formed) of the film 12, and the electrode roller 68 opposes the rear surface of the film 12. The film 12 is transported while the rear surface is in contact with a peripheral surface of the electrode roller 68.

As shown in FIG. 8, the image reading section 106 is provided with an image sensor 112 and a reading control section 114. As shown in FIG. 9, the image sensor 112 is arranged to oppose the front surface of the film 12 further to the upstream side of the film 12 in the transport direction than the discharging electrode 66 and the electrode roller 68. For example, a CCD line sensor or the like is used for the image sensor 112 and the image sensor 112 is opposed to the entirety of the film 12 in the width direction and reads an image which is formed on the film 12 which is transported on the transport path 108 before the corona discharging processing. Here, a transport roller 110C is provided on the transport path 108 to oppose the image sensor 112 and the image sensor 112 reads the image from the film 12 which is transported while the rear surface thereof is in contact with the peripheral surface of the transport roller 110C.

As shown in FIG. 8, the image sensor 112 is connected with the reading control section 114. The reading control section 114 reads the image which is formed on the film 12 through the image sensor 112. In addition, the reading control section 114 outputs the image data of the read image to the voltage control section 74 of the discharge control section 104 in synchronization with the transporting of the film 12. Here, by the CPU of the computer which functions as the voltage control section 74 executing a reading control program, an arbitrary configuration such as a configuration which functions as the voltage control section 74 or the like is utilized in the surface processing apparatus 100.

In the surface processing apparatus 100, according to the film 12 which is the processing target and the developer which is used for the image forming on the film 12, a table of a voltage (the discharge voltage Vd) according to the voltage $Vd_f$ and the image density Pd is set and stored in a non-volatile memory (not shown in the diagram) of the voltage control section 74. The voltage $Vd_f$ in the third exemplary embodiment is a reference strength which is the strength of the reforming processing which is able to obtain the desired wettability, writeability, and the like on the front surface of the film 12 in a non-image section. In addition, the voltage according to the image density Pd corresponds to the strength of the reforming processing which is necessary to set the image section to a reformed state which is a reference strength regardless of the image density Pd.

The voltage control section 74 sets the regions A in order on the front surface of the film 12 in the transport direction of the film 12, determines whether each of the regions A is an image section or a non-image section based on the image data which is input from the reading control section 114, and sets the voltage $Vd_f$ to the discharge voltage Vd for the regions A which are determined as non-image sections. In addition, the voltage control section 74 calculates the image density Pd for the regions A which are determined as image sections and sets the discharge voltage Vd with respect to the regions A.

When setting the discharge voltage Vd for the target regions A, the voltage control section 74 carried out control so as to apply the discharge voltage Vd to the discharging electrode 66 and the electrode roller 68 at a timing when the target regions A pass through the corona discharging processing position. Due to this, reforming processing is executed according to the images which are formed in each of the regions A and the film 12 which passes through the corona discharging processing position is sent to a laminating apparatus in a state where the desired wettability, writeability, and the like are obtained.

Here, in the third exemplary embodiment, description is given in which the configuration of the corona discharging section 62 of the corona discharging apparatus 60 is utilized as an example of the corona discharging section 102; however, without being limited thereto, the configuration of the corona discharging section 82 of the corona discharging apparatus 80 may be utilized. In a case of utilizing the configuration of the corona discharging section 82 as the corona discharging section 102, the configuration of the discharge control section 84 of the corona discharging apparatus 80 may also be used as the basic configuration of the discharge control section 104.

As described above, in the first, second, and third exemplary embodiments, reforming processing is performed using an appropriate discharging amount Pa with respect to the regions A which are non-image sections in which the front surface of the film 12 is exposed. For example, on a recording medium such as the film 12, reforming is carried out such that the wettability and writeability of the front surface are improved by performing the reforming processing using corona discharging processing and the like. However, when performing the reforming processing unnecessarily strongly with respect to the film 12 or the like, monomers such as impurities which are mixed in an inner section are precipitated to the front surface, which causes a reduction in the adhesion strength, changes in the color, changes in properties, and the like. Correspondingly, in the present exemplary embodiment, optimum reforming processing is performed with respect to regions where the film 12 is exposed.

Here, in the present exemplary embodiment described above, the discharge voltage Vd is controlled when changing the strength of the reforming processing with respect to the film 12; however, an arbitrary configuration which changes the strength of the reforming processing may be utilized as the reforming section. The strength of the surface reforming in the corona discharging processing is represented by the discharging amount Pa. The discharging amount Pa influences the discharge current and the discharge current is changed by changing the interval d. From here, for example, with regard to the discharging electrode 66, the strength of the surface reforming is controlled by controlling the discharge voltage Vd; however, the discharging electrode 66 may use a retractor mechanism which moves so as to change the interval d with the electrode roller 68. It is sufficient if the retractor mechanism moves the discharging electrode 66 so as to narrow the interval d with the electrode roller 68 in a case of increasing the strength of the reforming processing and moves the discharging electrode 66 so as to expand the interval d with the electrode roller 68 in a case of decreasing the strength of the reforming processing. In addition, a configuration according to the applied solution section may be utilized as the method for controlling the strength of the reforming section.

In addition, in the present exemplary embodiment, the regions A with a size which is determined in advance are set in the transport direction of the film 12; however, an arbitrary method such as setting based on image data may be utilized for the regions A. For example, in a case where non-image sections are continuous in the transport direction, the discharge voltage Vd may be set with continuous non-image sections set as one region A. At that time, the region A may be set with a size which is set in advance with respect to image sections on the film 12, or the regions A may be set according to the image density Pd.

In addition, an example is given in the present exemplary embodiment described above and the present invention is applied to an image forming apparatus with an arbitrary configuration which forms an image on a recording medium and a surface processing apparatus with an arbitrary configuration which generates a polar group by performing reforming processing with respect to the recording medium on which the image is formed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms a toner image according to image data on a transported recording medium;

a reforming section that generates a polar group on a first surface of the recording medium on which the toner image is formed, wherein the reforming section includes a corona discharging apparatus;

a fixing section that fixes the toner image on the transported recording medium, wherein the fixing section is located downstream of the image forming section in a transport direction of the transported recording medium and upstream of the reforming section in a transport direction of the transported recording medium; and a control section that sets target regions on the first surface of the recording medium in order in a transport direction and controls a strength of reforming processing applied by the reforming section to be a reference strength with respect to the target regions that are non-image sections, and the control section controls the strength of the reforming processing applied by the reforming section to be greater than the reference strength with respect to the target regions of image sections that include the toner image.

2. The image forming apparatus according to claim 1, wherein the image forming section forms the toner image on the recording medium using a developer that includes a toner and a release agent.

3. The image forming apparatus according to claim 1, wherein the control section controls the strength of the reforming processing applied by the reforming section to be increased as an image density is increased, and the image density is calculated based on the image data for each of the target regions on the first surface of the recording medium.

4. The image forming apparatus according to claim 1, wherein the corona discharging apparatus includes a discharging electrode that opposes the first surface of the recording medium on which the toner image is formed, an opposite electrode that opposes a second surface of the recording medium, and a discharging power source that outputs a discharge voltage to the discharging electrode, and the control section controls the discharge voltage of the discharging power source according to the strength of the reforming processing.

5. The image forming apparatus according to claim 4, wherein the discharging electrode includes a plurality of partial electrodes which are arranged in a direction which intersects with the transport direction of the recording medium, the discharging power source outputs the discharge voltage for each of the plurality of partial electrodes, and the control section sets width regions that correspond to each of the partial electrodes on the first surface of the recording medium in the target region and controls the discharge voltage of the partial electrodes corresponding to each of the width regions based on the image data.

6. The image forming apparatus according to claim 1, wherein the recording medium is a film.

7. The image forming apparatus according to claim 1, wherein the corona discharging apparatus includes a discharging electrode that opposes the first surface of the recording medium on which the toner image is formed, an opposite electrode that opposes a second surface of the recording medium, and a discharging power source that outputs a discharge voltage to the discharging electrode, and the control section controls a position of the discharging electrode according to the strength of the reforming processing.

8. A surface processing apparatus comprising:

a transport section that transports a recording medium on which a toner image is formed;

an image reading section that reads the toner image which is formed on the recording medium which is transported by the transporting section and outputs image data according to the read toner image;

a reforming section that is provided at a downstream side of the image reading section in a transport direction of the recording medium and generates a polar group by performing reforming processing on a first surface of the recording medium on which the toner image is formed, wherein the reforming section includes a corona discharging apparatus;

a fixing section that fixes the toner image formed on the recording medium, wherein the fixing section is located upstream of the reforming section in a transport direction of the recording medium; and a control section which sets target regions on the first surface of the recording medium in order in the transport direction and controls a strength of the reforming processing applied by the reforming section to be a reference strength with respect to the target regions that are non-image sections based on the image data, and the control section controls the strength of the reforming processing applied by the reforming section to be greater than the reference strength with respect to the target regions of image sections that include the toner image.

9. The surface processing apparatus according to claim 8, wherein the control section controls the strength of the reforming processing to be increased as an image density is increased, and the image density is calculated based on the image data for each of the target regions on the first surface of the recording medium.

10. The surface processing apparatus according to claim 8, wherein the corona discharging apparatus includes a discharging electrode that opposes the first surface of the recording medium on which the toner image is formed, an opposite electrode that opposes a second surface of the recording medium, and a discharging power source that outputs a discharge voltage to the discharging electrode, and the control section controls the discharge voltage of the discharging power source according to the strength of the reforming processing.

11. The surface processing apparatus according to claim 10, wherein the discharging electrode includes a plurality of partial electrodes that are arranged such that each of the regions of the reforming processing is continuous in a direction which intersects with the transport direction of the recording medium, the discharging power source outputs the discharge voltage for each of the plurality of partial electrodes, and the control section sets width regions that correspond to each of the partial electrodes on the first surface of the recording medium in the target region and controls the discharge voltage of the partial electrodes corresponding to each of the width regions based on the image data.

12. The surface processing apparatus according to claim 8, wherein the corona discharging apparatus includes a discharging electrode that opposes the first surface of the recording medium on which the toner image is formed, an opposite electrode that opposes a second surface of the recording medium, and a discharging power source that outputs a discharge voltage to the discharging electrode, and the control section controls a position of the discharging electrode according to the strength of the reforming processing.

* * * * *